US005909708A

United States Patent [19]

Bolza-Schünemann

[11] Patent Number: 5,909,708

[45] Date of Patent: Jun. 8, 1999

[54] SHEET-FED OFFSET ROTARY PRINTING MACHINE

[75] Inventor: Hans-Bernhard Bolza-Schünemann, Würzburg, Germany

[73] Assignee: Koenig & Bauer-Albert Aktiengesellschaft, Wurzburg, Germany

[21] Appl. No.: 08/983,131

[22] PCT Filed: Jul. 15, 1996

[86] PCT No.: PCT/DE96/01278

§ 371 Date: Jan. 20, 1998

§ 102(e) Date: Jan. 20, 1998

[87] PCT Pub. No.: WO97/03831

PCT Pub. Date: Feb. 6, 1997

[30] Foreign Application Priority Data

Jul. 18, 1995 [DE] Germany ..... 195 26 115
Oct. 17, 1995 [DE] Germany ..... 195 38 546

[51] Int. Cl.[6] ..... B41F 7/14

[52] U.S. Cl. ..... 101/177; 101/232

[58] Field of Search ..... 101/177, 175, 101/183, 184, 216, 217, 232, 185, 136, 137, 140, 142, 144

[56] References Cited

U.S. PATENT DOCUMENTS

| | | | |
|---|---|---|---|
| 4,479,431 | 10/1984 | Germann . | |
| 4,815,376 | 3/1989 | Sarda . | |
| 4,854,232 | 8/1989 | Oda | 101/211 |
| 5,036,763 | 8/1991 | Germann | 101/177 |
| 5,469,787 | 11/1995 | Turner et al. . | |
| 5,479,856 | 1/1996 | Wirz | 101/177 |

FOREIGN PATENT DOCUMENTS

| | | |
|---|---|---|
| 0 420 234 | 4/1991 | European Pat. Off. . |
| 31 13 055 | 10/1982 | Germany . |
| 2 060 494 | 5/1981 | United Kingdom . |

*Primary Examiner*—J. Reed Fisher
*Attorney, Agent, or Firm*—Jones, Tullar & Cooper, P.C.

[57] ABSTRACT

A sheet-fed offset rotary printing machine is used for multicolor printing. A plate cylinder and a rubber blanket cylinder are utilized, as are first and second impression cylinders. Either of these two impression cylinders is operable with the blanket cylinder. Sheets to be printed can have a length corresponding to a nominal diameter, or to twice a nominal diameter. The first impression cylinder has a plurality of controllable gripper systems while the second impression cylinder has at least one controllable gripper system.

11 Claims, 1 Drawing Sheet

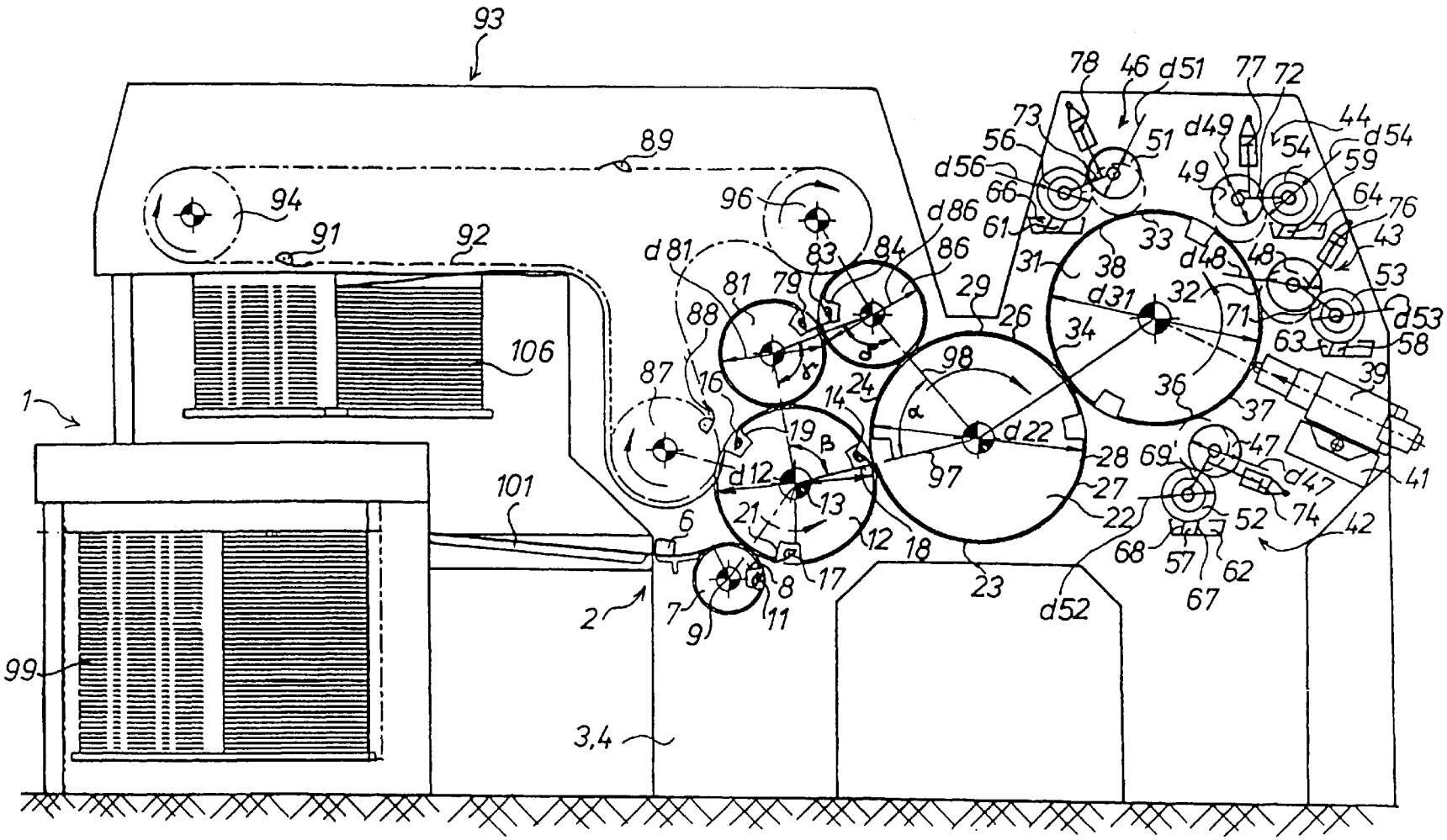

SHEET-FED OFFSET ROTARY PRINTING MACHINE

FIELD OF THE INVENTION

The present invention relates to a sheet-fed offset rotary printing press.

DESCRIPTION OF THE PRIOR ART

A three-cylinder rotary rubber-blanket printing press is known from DE-PS 435 592, wherein the plate cylinder and the rubber blanket cylinder each have at least two print areas, and an impression cylinder has one more print area than the rubber blanket cylinder.

It is a limitation of this prior printing press that registration problems can occur. A sheet to be printed is already removed from the impression cylinder by a gripper system before this sheet has been completely printed.

SUMMARY OF THE INVENTION

It is the object of the present invention to create a sheet-fed offset rotary printing press. By use of this press it is possible to imprint sheets of a sheet length matched to a single nominal diameter as well as a sheet length matched to twice the nominal diameter.

In accordance with the invention, this object is attained by means of a sheet-fed offset rotary printing press having the provision of a printing cylinder, a rubber blanket cylinder and a first, central impression cylinder that is provided with a plurality of controllable gripper systems. The number of gripper systems on the impression cylinder is not equal to the number of print areas on the printing cylinder. A second impression cylinder, that is provided with at least one controllable gripper system, is also assigned to the rubber blanket cylinder. Either the first or the second impression cylinder is arranged to selectively act together with the rubber blanket cylinder.

The sheet-fed offset rotary printing press in accordance with the present invention can be operated in an advantageous manner in two modes of operation: in the first mode of operation, sheets in a single length format can be printed in four colors. Sheets in a double length format can be printed in two colors by means of a second impression cylinder in the second mode of operation.

It is advantageous that by means of the sheet-fed offset rotary printing press in accordance with the present invention, a four-color printing process with a register of the highest accuracy can be achieved, since during all printing steps the sheets to be printed are maintained in a single gripper system on an impression cylinder. Only after each sheet has been completely printed, are the printed sheets taken over by a second gripper system and removed from the impression cylinder.

By the utilization of a sheet-feeding device synchronized with the impression cylinder, and which accelerates the sheets to be fed in from a state of rest to the circumferential speed of the impression cylinder, assured sheet-feeding with very accurate contact registration is achieved. This is achieved even at high speeds for example at speeds of 6,000 sheets per hour.

It is of particular advantage that a laser inscribing system is assigned to the printing cylinder and that therefore plates which can be laser-inscribed are inscribed directly in the printing press in a so-called computer-to-press process. Therefore, no registration difficulties occur, as have previously been caused by the mounting of the plates on the printing cylinder or because of errors during the production of the plates. It is therefore possible to omit circumferential, lateral or transverse registration adjustment devices.

The short inking units without inking zones minimize the set-up times and simplify the operation of the printing press. In particular, the short inking units make possible a very small structural size of the entire printing press. The short inking units are each only in contact with one print area of the printing cylinder, so that in the pulled-back state multiple rolling only takes place against a screen roller. By means of different diameters of the application roller and of the screen roller, an existing color relief is reduced in the circumferential direction. The screen roller cooperates with a chamber doctor blade, which completely removes remnants of the ink relief and generates a completely even color film on the screen roller.

Dampening units are omitted when using plates suitable for dry offset printing. Know problems caused by dampening means, for example problems of emulsifying or increased stenciling, cannot be generated.

The feed stack and the delivery stack are located on one side of the press, which improves serviceability. Furthermore, the side to be printed of the sheets to be fed is down, while with the delivered sheets of the delivery stack, the printed side is on the top. Therefore, the turning of the stack following obverse printing for printing the sheets on the reverse side is not necessary.

The sheet-fed offset rotary printing press in accordance with the present invention is compact, minimizes set-up times, simplifies operation and still assures multi-color, stencil-free quality prints with excellent registration. This sheet-fed rotary printing press is particularly suited for small orders in a range between 100 to 10,000 sheets.

BRIEF DESCRIPTION OF THE DRAWING

The sheet-fed offset rotary printing press in accordance with the present invention is represented in the sole drawing which shows a schematic, side-elevation view of the sheet-fed offset rotary printing machine, and will be described in detail in what follows.

DESCRIPTION OF THE PREFERRED EMBODIMENT

A stream feeder 1 is placed upstream of a sheet feeder 2 of a sheet-fed offset rotary printing press, as seen in the sole drawing FIGURE. By means of this stream feeder 1 it is possible to process sheets of a sheet length matched to a single or double nominal diameter dn, for example dn =132 mm, of the sheet-fed offset rotary printing press, for example 350 mm and 700 mm. The sheet feeder 2 is seated in lateral frames 3, 4 of the sheet-fed offset rotary printing press and essentially consists of a lateral alignment device, for example a pull type or suction guide or lay 6, a sheet-feeding device 7 and front stops 8.

For example, the sheet-feeding device 7 is embodied as a rotating stop drum 7, which is provided at the circumference with a gripper system 11, extending in the direction of an axis of rotation 9 of the stop drum 7. A row with at least two front stops 8 is respectively arranged in the area of these gripper systems 11. The drive of the stop drum 7 is provided, for example synchronized with the press cycle, by means of an electric drive, not represented, which accelerates the stop drum 7 from a standstill to the circumferential speed of a first, central impression cylinder 12 and subsequently again brakes it to a standstill. The sheet-feeding device 7 can also be embodied as an oscillator or a suction drum, or can operate in stages with a combination of a suction drum and stop drum or oscillator, and is arranged below the sheets to be fed.

The central impression cylinder 12 is of a diameter d12, for example d12=396 mm, which corresponds to an odd multiple N, for example three times, of the nominal diameter dn, and is provided with a number of gripper systems 14, 16, 17, corresponding to the odd multiple N, for example three, which gripper systems 14, 16 and 17 are offset by respectively 120° and extend parallel with the axis of rotation 13 of cylinder 12. For opening and closing, these controllable gripper systems 14, 16, 17, which cooperate with gripper supports 18, 19, 21, are actuated by means of cam rollers cooperating with adjustable control cams.

A rubber blanket cylinder 22, which, for example, has four times the nominal diameter dn, of a diameter d22, for example, d22 =528 mm, and which has four opposite print areas 23, 24, 26, 27, of the same size, cooperates with this first impression cylinder 12. The rubber blanket cylinder 22 can be covered with two rubber blankets 28, 29, respectively corresponding to two associated print areas 23, 27, or respectively 24, 26, but also can be covered with a single rubber blanket corresponding to the four print areas 23, 24, 26, 27. At least two print areas 24, 26, or 23, 27, are located directly behind each other without a groove between them.

A corresponding printing cylinder 31 is associated with this rubber blanket cylinder 22. The quadruple-sized printing cylinder 31 of a diameter d31, for example d31=528 mm also has four print areas 32, 33, 34, 36 associated with the print areas 23, 24, 26, 27 of the rubber blanket cylinder 22. These print areas 32, 33, 34, 36 are constituted, for example, by plates 37, 38 supporting printing formes, wherein respectively two of these print areas 33, 34, or respectively 32, 36 of the printing cylinder 31 can be provided with their own plate 37, 38, or all four print areas 32, 33, 34, 36 with a common plate, which then supports four printing formes. Here, too, at least two print areas 33, 34, or respectively 32, 36, are located directly behind each other. Special plates 37, 38, suitable for waterless offset printing, are preferably used, so that dampening units can be omitted. The described sheet-fed offset rotary printing press operates with flat printing plates. However, it is also possible to use letterpress printing plates (letter set). With direct letterpress printing, the rubber blanket cylinder 22 can be omitted.

Its own laser inscribing system 39 is associated with the printing cylinder 31 for the direct inscribing of plates 37, 38 suited for such laser inscription. Prior to inscribing, these plates 37, 38 are positioned on the printing cylinder 31 and can be individually supplied to the printing cylinder 31. However, it is also possible to provide the printing cylinder 31 with a hollow interior space and to arrange there a supply and support spindle of a foil which can be inscribed by laser.

The rubber blanket and printing cylinders 22, 31 can each be equipped with more than four print areas, wherein the impression cylinder 12 for example then supports one gripper system more or less than the number of print areas of the printing cylinder 31. The number of the gripper systems 14, 16, 17, of the impression cylinder 12 is not equal to the number of the print areas 32, 33, 34, 36, of the printing cylinder 31.

In the preferred embodiment, the laser inscribing system 39 is seated on a cross bar 41 extending parallel with the axis of rotation 13 of the first impression cylinder 12. For example, in this case a plurality of independent laser diodes are located in a fixed location and are respectively connected with one end of an optical wave guide. The other ends of the optical wave guides are arranged close to each other on a carriage, wherein a plurality, for example 64 of the optical wave guides is respectively oriented toward each printing cylinder 31. The carriage can be axially displaced on the cross bar 41 parallel with the longitudinal direction of the printing cylinder 31. It is also possible to omit the axially movable carriage and to arrange the optical wave guides fixed in place and oriented toward the respective printing cylinder 31, wherein then a number of optical wave guides corresponding to the desired resolution of the print image is provided over a total length of the printing cylinder 31.

Each one of the print areas 32, 33, 34, 36, of the printing cylinder 31 is inked by its own inking unit 42, 43, 44, 46. For this purpose, the inking units 42, 43, 44, 46 can be alternatingly placed against and removed from the printing cylinder 31, so that respectively only the associated print area 32, 32, 32, 36 is inked. In the present preferred embodiment, the inking units 42, 43, 44, 46 are designed as short inking units 42, 43, 44, 46. These short inking units 42, 43, 44, 46 each essentially consists of an ink application roller 47, 48, 49, 51, which inks the print areas 32, 33, 34, 36, a driven screen roller 52, 53, 54, 56, a chamber doctor blade 57, 58, 59, 61, and a catch basin 62, 63, 64, 66. The respective ink application roller 47, 48, 49, 51 can also be embodied to be driven, wherein it is possible to provide a common drive with each associated screen roller 52, 53, 54, 56, or an individual independent drive which, for example, can be regulated. A diameter d47, d48, d49, d51, for example=130 mm, of each of the ink application rollers 47, 48, 49, 51 is different from a diameter d52, d53, d54, d56, for example=131 mm, of each of the screen rollers 52, 53, 54, 56. The chamber doctor blades 57, 58, 59, 61, each having a working and a finishing doctor blade 67, 68, supply the screen rollers 52, 53, 54, 56 with ink, which is metered by means of the working doctor blade 67. Surplus ink, which is removed from the screen rollers 52, 53, 54, 56 by means of the respective finishing doctor blade 68, is received in the catch basin 62, 63, 64, 66 and returned to an inking cycle. The screen rollers 52, 53, 54, 56 and the rubber-coated ink application rollers 47, 48, 49, 51 are in constant contact with each other, while the ink application rollers 47, 48, 49, 51 can be placed against the respective print areas 32, 33, 34, 36 in synchronization with the printing cylinder 31. To this end, the respective ink application rollers 47, 48, 49, 51 are seated on both sides in single-armed levers 69, 71, 72, 73, which are pivotable around the screen rollers 52, 53, 54, 56. These levers 69, 71, 72, 73 can be actuated mechanically, for example by means of a cam gear, or electrically, for example by means of a magnet valve cooperating with a work cylinder 74, 76, 77, 78, which can be charged with a pressure medium.

In place of the described short inking units 42, 43, 44, 46, it is also possible to use conventional inking units provided with ink ducts and duct-adjusting screws. In this case, their ink application rollers are in constant contact with the remaining ink rollers of the conventional inking units, and can be moved toward or away from the printing cylinder 31 while only inking the respective associated print area 32, 33, 34, 36.

A transfer drum 81, provided with a gripper system 79, which can be controlled by means of cam rollers and cam plates, and having twice the nominal diameter dn, for example d81=264 mm, is arranged after the rubber blanket cylinder 22 in the production direction, and selectively works together with the impression cylinder 12. A second impression cylinder 86, which is provided with a controllable gripper system 83 and gripper supports 84 and having a diameter d86, for example d86=264 mm, corresponding to twice the nominal diameter dn, is situated after this transfer drum 81, in the production direction and can be selectively brought against or removed from contact with the rubber blanket cylinder 22. The second impression cylinder 86 can also have a diameter d86 corresponding to an even number multiple M of the nominal diameter dn, and can be provided with a number of gripper systems 83 corresponding to one half of this multiple, M/2. A first chain wheel shaft 87 is arranged in the production direction downstream of the rubber blanket cylinder 22, so that controllable chain gripper systems 88, 89, 91 selectively cooperate with the first or central impression cylinder 12. The chain wheel shaft 87 guides a chain 92 of a chain gripper delivery device 93. This chain 92 is equipped with, for example, three chain gripper systems 88, 89, 91, wherein a distance d, for example d=1659 mm, between two chain gripper systems 88, 89, 91 in respect to each other corresponds, with the chain 92 stretched out, to one circumferential length of the rubber blanket, or plate cylinder 22 or 31 respectively. However, this distance d can also be made less if the chain revolves unevenly, for example slowed for sheet delivery.

This endless chain 92, equipped in this manner, is reversed by a second chain wheel shaft 94 and runs over a third chain wheel shaft 96 back to the first chain wheel shaft 87 assigned to the first impression cylinder 12. The third chain wheel shaft 96 is arranged in such a way that the chain gripper systems 88, 89, 91 also work selectively together with the second impression cylinder 86.

The second impression cylinder 86 and the associated transfer drum 81 must be arranged in such a way that the sum of the circumferential lengths located in the conveying direction of the rubber blanket cylinder 22, of the transfer drum 81 and of the second impression cylinder 86, starting at a median line 97 of the first impression cylinder 12 and the rubber blanket cylinder 22, and ending at a median line 98 of the second impression cylinder 86 and the rubber blanket cylinder 22, is a whole number multiple of a nominal circumference resulting from the nominal diameter dn minus the circumferential length, lying between the two median lines 97, 98 of the two impression cylinders 12, 18, of the rubber blanket cylinder 22.

The median line 98 formed by the second impression cylinder 86 and the rubber blanket cylinder 22 forms an angle $\alpha$, for example $\alpha$=65.35°, with the median line 97 formed by the first impression cylinder 12 and the rubber blanket cylinder 22.

The operation of the sheet-fed offset rotary printing press in accordance with the present invention in a first mode of operation, for four-color printing with a single length sheet format, is as follows:

The stream feeder 1 separates sheets, whose sheet length has been matched to the single nominal diameter dn, from a stack of sheet 99 and feeds these single sheets over a suction belt table 101 to the stop drum 7, which is at rest. There, a front edge of a first fed sheet 102 is aligned at the front stops 8 parallel in respect to the axis of rotation 9 of the stop drum 7. Subsequently, the suction guide or lay 6 grips the first sheet 102 and aligns it laterally. Following the alignment of the sheet 102, the gripper system 12 of the stop drum 7 is closed, and the stop drum 7 accelerates the sheet 102 from a standstill to the circumferential speed of the impression cylinder 12. After having reached the circumferential speed, the gripper system 11 of the stop drum 7 transfers the sheet 102 to the first gripper system 14 of the first or central impression cylinder 12. The latter conveys the sheet 102 to the rubber blanket cylinder 22 and the sheet 102 is printed by the print area 23 of the rubber blanket cylinder 22. Previously, the print area 32 of the printing cylinder 31, which had been inked by the inking unit 42 with, for example, black ink, has transferred its print image to the ink area 23 of the rubber blanket cylinder 22.

An angle $\beta$ between median lines of the first impression cylinder 12 and the rubber blanket cylinder 22, or respectively the transfer drum 81 is $\beta$=84°. An angle $\gamma$ between median lines of the transfer drum 81 and the impression cylinder 12, or respectively the second impression cylinder 86 is $\gamma$=103°. An angle $\delta$ between median lines of the impression cylinder 86 and the transfer drum 81 and the rubber blanket cylinder 22 is $\delta$=108°.

The sheet 102, provided with a first printed image in this way and held by the gripper system 14, is transported past the transfer drum 81 and the chain wheel shaft 87.

In the meantime, the second and third gripper systems 16, 17 of the impression cylinder 12 have passed by the stop drum 7 without picking up a sheet in the process. The first gripper system with the first sheet 102 provided with the first print image is turned past the stop drum 7, and is now printed with the second print image by the print area 24 of the rubber blanket cylinder 22, which had previously been supplied with a second print image for example in the print color "cyan" by means of the inking unit 43 and the print area 33 of the printing cylinder 31.

The second gripper system 16 now takes up the second sheet 103 from the stop drum 7, which second sheet 103 is fed to the stop drum 7 and is aligned in the same manner as the first sheet 102. This second sheet 103, too, is first imprinted by the print area 23 of the rubber blanket cylinder 22 having the print image of the print area 32 of the printing cylinder 31. In the course of this, the first sheet 102 was conveyed past the transfer drum 81, the chain wheel shaft 87 and the stop drum 7 without the gripper system 14 being opened. The first sheet 102 now reaches the rubber blanket cylinder 22 for the third time. The sheet 102 now is imprinted by the third print area 26 with the third print image, which was transferred to the print area 26 of the rubber blanket cylinder 22 by the print area 34 of the printing cylinder 31 inked, for example, with the print color "magenta" by means of the inking unit 44. Thereafter, the following second sheet 103 is printed in the color "cyan" by the second print area 24 of the rubber blanket cylinder.

In the meantime, the third gripper system 17 has taken up a third sheet 104 from the gripper system 11 of the stop drum 7, which now, the same as the first and second sheets 102, 103, is initially imprinted by the print areas 23 of the rubber blanket cylinder 22 with the color "black". During this time, the, first sheet 102 was again passed by the transfer drum 81, the chain wheel shaft 87 and the stop drum 7, and the fourth print image was transferred to the fourth print area 27 of the rubber blanket cylinder 22 by the print area 36 of the printing cylinder 31 inked, for example, with yellow ink, by means of the inking unit 46. This print area 27 imprints the fourth print image on the first sheet 102. Subsequently the second sheet 103 is provided with the third print image in the color "magenta", and the third sheet 104 in the color "cyan".

At the end of the fourth printing operation, the completely printed first sheet 102, which is now provided with four print images, is taken over by the chain gripper system 89 in the area of the chain wheel shaft 87, even at maximum format length, for example 360 mm. In the process, the gripper system 14 is opened for the first time after having taken over the initially unprinted first sheet 102 from the first gripper system 11 of the stop drum 7, thus the sheet 102 was imprinted with four print images during one closure of the gripper.

The chain gripper system 89 now transports the sheet 102 in the chain gripper delivery device 93 as far as into the area of a stack 106. There, the chain gripper system 89 is opened and the first sheet 102 is deposited on the stack 106. The now empty gripper system 14 subsequently takes over a fourth sheet 107 from the gripper system 11 of the stop drum 7, which is again provided with the first print image in the color "black" by the first print area 23 of the rubber blanket cylinder 22.

The second gripper system 16 of the impression cylinder 12 transports the second sheet 103, now imprinted with three print images, to the rubber blanket cylinder 22, by which the fourth print image is transferred to the second sheet 103, and thereafter the third print image to the third sheet 104.

The second sheet 103, in the meantime provided with four print images, is transferred to the chain gripper system 88 and transported to the stack 106. The empty gripper system 16 of the impression cylinder 12 takes up a fifth sheet 108 from the stop drum 7.

These described processes are periodically repeated, so that respectively one sheet imprinted with four print images reaches the chain gripper delivery device 83 per revolution of the printing cylinder 31, or respectively the rubber blanket cylinder 22, and is deposited there on the stack 106, and a new sheet is respectively supplied to the impression cylinder after 1 ½ revolutions of the impression cylinder 12.

In this first mode of operation, the transfer drum 81 and the second impression cylinder 86 do not function.

In a second mode of operation, the function of the sheet-fed offset rotary printing press in accordance with the present invention is as follows:

Sheets of double length are imprinted in two colors in this second mode of operation, whose sheet length has been matched to the double nominal diameter dn.

To this end—in the same way as in the first mode of operation—a sheet 109 is supplied to the first impression cylinder 12 respectively after each 1 ⅓ revolutions of the first impression cylinder 12, i.e. to each fourth gripper system 14, 16, 17 of the impression cylinder 12. This sheet 109 is passed by the rubber blanket cylinder 22, wherein the rubber blanket cylinder 22 and the first impression cylinder 12 do not act together and therefore the sheet 109 is not imprinted at this location. The first impression cylinder 12 acts only as a transfer drum. The gripper systems 14, 16, 17, 79 of the first impression cylinder 12 and the transfer drum 81 are now controlled in such a way that the sheet 109 is taken over by the transfer drum 81. The gripper system 79 of the transfer drum 81 passes on the sheet 109 to the gripper system 83 of the second impression cylinder 86. This second impression cylinder 86 has now been arranged so that it acts together with the rubber blanket cylinder 22. In this mode of operation, the rubber blanket cylinder 22 and the printing cylinder 31 have two print images of double length, which are each transferred by respectively two print areas 24, 26, or respectively 23, 27 of the rubber blanket cylinder 22 located next to each other without a groove, or respectively by two print areas 33, 24, or respectively 32, 36 of the printing cylinder 31 located next to each other without a groove. The sheet 109 remains on the second impression cylinder 86 during two revolutions of the second impression cylinder 86 and in this way is provided with two double length print images, one after the other, by the rubber blanket cylinder 22. During the second revolution of the second impression cylinder 86, the start of the sheet 109 is already taken over by the respective gripper system 88, 89, 91 of the chain gripper delivery device 93 and conveyed to the stack 106. This now empty gripper system 83 now takes over the next sheet from the transfer drum 81, and the described process is periodically repeated.

While a preferred embodiment of a sheet-feed, offset rotary printing machine in accordance with the present invention has been set forth fully and completely hereinabove, it will be apparent to one of skill in the art that a number of changes in, for example, the drive assembly for the press, the type of sheet feeder and stream feeder used and the like may be made without departing from the true spirit and scope of the present invention, which is accordingly to be limited only by the following claims.

What is claimed is:

1. A sheet-fed offset rotary printing press for multi-color printing comprising:

a printing cylinder having a first diameter and a number of printing areas;

a rubber blanket cylinder engaging said printing cylinder and having said first diameter and said number of printing areas, said first diameter being a multiple of a nominal diameter;

a first, central impression cylinder engaging said rubber blanket cylinder;

a number of controlled gripper systems on said first, central impression cylinder, said number of controlled gripper systems being not equal to said number of printing areas on said printing cylinder; and a second impression cylinder, said second impression cylinder having at least one controllable gripper system, said second impression cylinder being in engagement with said rubber blanket cylinder, said first and second impression cylinders being arranged to selectively act with said rubber blanket cylinders.

2. The sheet-fed offset rotary printing press in accordance with claim 1 wherein said second impression cylinder has a second diameter which is an even number multiple of said nominal diameter and further wherein said second impression cylinder is provided with a number of controllable gripper systems equal to one half of said even number multiple.

3. The sheet-fed, offset rotary printing press of claim 1 wherein said first impression cylinder has a third diameter which is an odd number multiple of said nominal diameter, and further wherein said first impression cylinder is provided with a number of controllable gripper systems equal to said odd number multiple.

4. The sheet-fed, offset rotary printing press of claim 1 wherein said first impression cylinder acts together with said rubber blanket cylinder, and said second impression cylinder does not function.

5. The sheet-fed, offset rotary printing press of claim 1 wherein said first impression cylinder is a transfer cylinder and said second impression cylinder acts with said rubber blanket cylinder.

6. The sheet-fed, offset rotary printing press of claim 5 further including a transfer drum disposed between said first and second impression cylinders.

7. The sheet-fed, offset rotary printing press of claim 1 wherein said first diameter is four times a nominal diameter.

8. The sheet-fed, offset rotary printing press of claim 2 wherein said second impression cylinder has said second diameter equal to twice said nominal diameter.

9. The sheet-fed, offset rotary printing press of claim 3 wherein said first impression cylinder is provided with said third diameter equal to three times said nominal diameter.

10. The sheet-fed, offset rotary printing press of claim 1 further including a chain gripper delivery device having controllable chain gripper systems and wherein sheets printed by said printing press are selectively transferred from said first and second impression cylinder to said chain gripper systems.

11. A sheet-fed offset rotary printing press for multi-color printing comprising:

a printing cylinder having a number of printing areas, said number of printing areas on said printing cylinder being greater than one;

a first impression cylinder cooperating with said printing cylinder and having a number of controllable gripper systems, said number of controllable gripper systems on said first impression cylinder being not equal to said number of printing areas on said printing cylinder; and a second impression cylinder cooperating with said printing cylinder, and having at least one controllable gripper system, said first and second impression cylinders being arranged to selectively act together with said printing cylinder.

* * * * *